United States Patent [19]

Nakagami et al.

[11] Patent Number: 4,485,777

[45] Date of Patent: Dec. 4, 1984

[54] MULTI-CYLINDER INTERNAL COMBUSTION ENGINE

[75] Inventors: Tatsuro Nakagami; Yoshiaki Danno, both of Kyoto, Japan

[73] Assignee: Mitsubishi Jidosha Kogyo Kabushiki Kaisha, Tokyo, Japan

[21] Appl. No.: 605,987

[22] Filed: May 2, 1984

Related U.S. Application Data

[63] Continuation of Ser. No. 359,865, Mar. 19, 1982, abandoned.

[30] Foreign Application Priority Data

Mar. 23, 1981 [JP] Japan ..... 56-40448

[51] Int. Cl.[3] ..... F02D 13/06

[52] U.S. Cl. ..... 123/198 F; 123/90.15; 123/481; 123/580

[58] Field of Search ..... 123/198 F, 487, 580, 123/90.15, 90.16

[56] References Cited

U.S. PATENT DOCUMENTS 4,104,991 8/1978 Abdoo ..... 123/198 F
4,144,863 3/1979 Abdoo ..... 123/481
4,227,505 10/1980 Larson et al. ..... 123/198 F
4,263,782 4/1981 Matsumoto et al. ..... 123/198 F

*Primary Examiner*—Ira S. Lazarus

[57] ABSTRACT

In a multi-cylinder internal combustion engine having a plurality of cylinders which are supplied with air via one common throttle valve and a control unit for regulating the number of operating cylinders to rest an arbitrary number of cylinders by blocking the air supply to said cylinders, the output of the engine under $Z_1$-cylinder operation is known to come to coincide with the output under $Z_2$-cylinder operation at one point with the same degree of opening of the throttle valve under a given constant rate of the engine rotation. At such a point, the pressure of the intake manifold under both the $Z_1$-cylinder operation and the $Z_2$-cylinder operation remain at or close to a certain value respectively over a wider range of rotation of the engine. This multi-cylinder internal combustion engine enables smooth switching between the $Z_1$-cylinder operation and the $Z_2$-cylinder operation without causing fluctuation in output nor shock by detecting the pressure at the intake manifold and the control unit for such switching can be made simple in construction.

3 Claims, 13 Drawing Figures

MULTI-CYLINDER INTERNAL COMBUSTION ENGINE

This application is a continuation of application Ser. No. 359,865, filed Mar. 19, 1982, now abandoned.

BACKGROUND OF THE INVENTION

The present invention relates to a multi-cylinder internal combustion engine which is capable of regulating the number of cylinders in operation by shifting a given number of cylinders to rest, and aims to obviate shocks caused by fluctuation in the output at the time of such switching.

There have been known in prior art multi-cylinder engines which can increase the combustion efficiency of cylinders in operation to prevent toxic exhaust gas or which can reduce pumping loss through an increase in load rate to better fuel economy, by shifting the number of operating cylinders from the total number at low-load to a given number. There are conventionally known various methods for suspending the operation of cylinders such as disclosed in U.S. Pat. Nos. 4,221,200, and 4,221,201 and BP 2,075,118. In one of such methods, the operation of the intake and exhaust valves(s) is suspended; it is also known to stop the operation of a fuel supply system provided for each cylinder (in many cases an electrically controlled fuel injection valve provided on branched pipes of the intake manifold) or the like.

These multi-cylinder engines, however, are defective in that the output of the engine would fluctuate when the operation of cylinders is suspended, and when carried on automotive vehicles, it might cause a shock, presenting difficulties in smooth driving. Such switching methods further involve a complicated control means.

SUMMARY OF THE INVENTION

The present invention aims to provide a multi-cylinder internal combustion engine characterized by a control unit which is capable of switching the number of cylinders in operation from an arbitrary number (hereinafter called $Z_1$-cylinder operation) to another arbitrary number (hereinafter called $Z_2$-cylinder operation) without causing fluctuation in the output nor shock, and which is simple in structure.

Such an object is achieved by a multi-cylinder combustion engine having a plural number of cylinders which are supplied with air through one common throttle valve, which can suspend an arbitrary number out of said plural cylinders by blocking the air supply to the cylinders so as to shift the number of cylinders in operation, and more particularly by a multi-cylinder combustion engine provided with a control means structured to detect a intake manifold pressure under the operation with a given number of cylinder under which the outputs before and after such shift substantially coincide in order to shift from the operation with a given number of cylinders to that with another given number of cylinders at or around such pressure, and to detect the intake manifold pressure under the operation with the second given number of cylinders under which the outputs before and after becomes substantially identical in order to shift at or around the pressure, thereby carrying out such shifting at an arbitrary rotation rate under the operation condition where the outputs before and after the change in the number of cylinders become almost the same with the same throttle reduction.

BRIEF DESCRIPTON OF THE DRAWINGS

FIG. 1 shows a graph explaining the cross point.

FIGS. 2(*a*), (*b*) and (*c*) are graphs showing the pressure at the intake manifold respectively when the entine is operating under different number of cylinders but at the same output and at the same throttle valve reduction.

Figure 5:
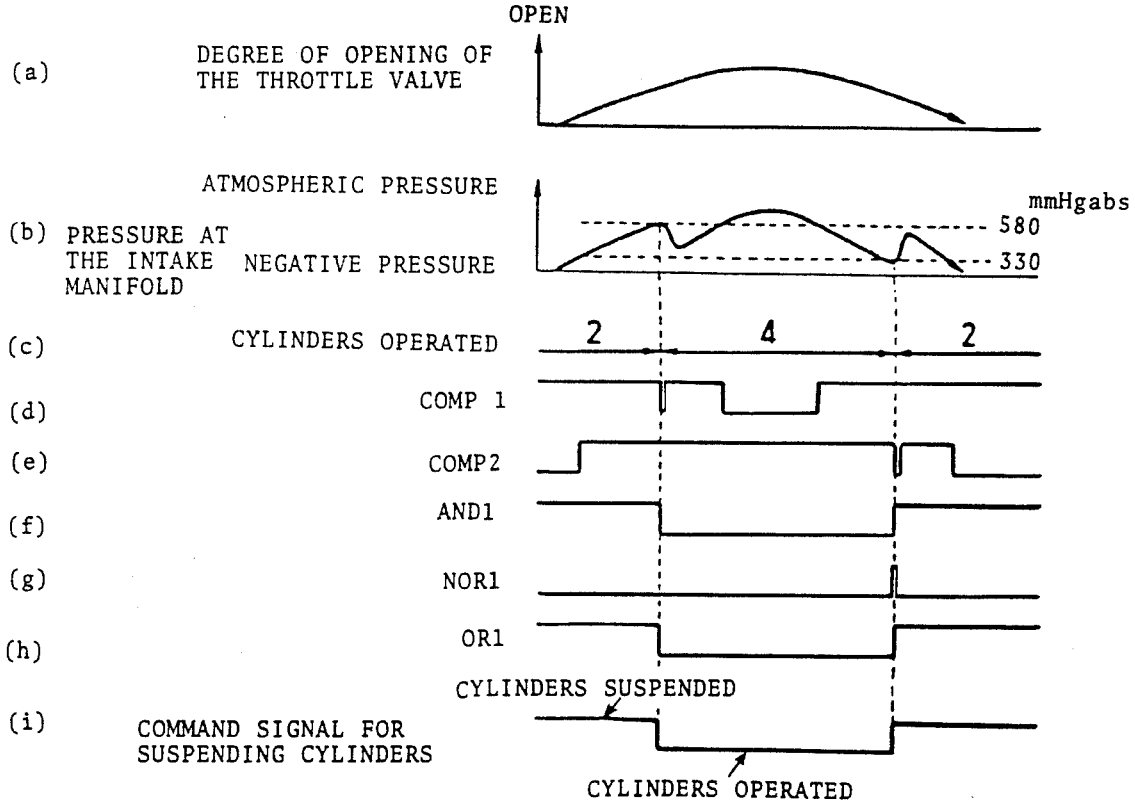

FIGS. 5(*a*)–(*i*) are the time charts of the signals at various parts.

Figure 6:
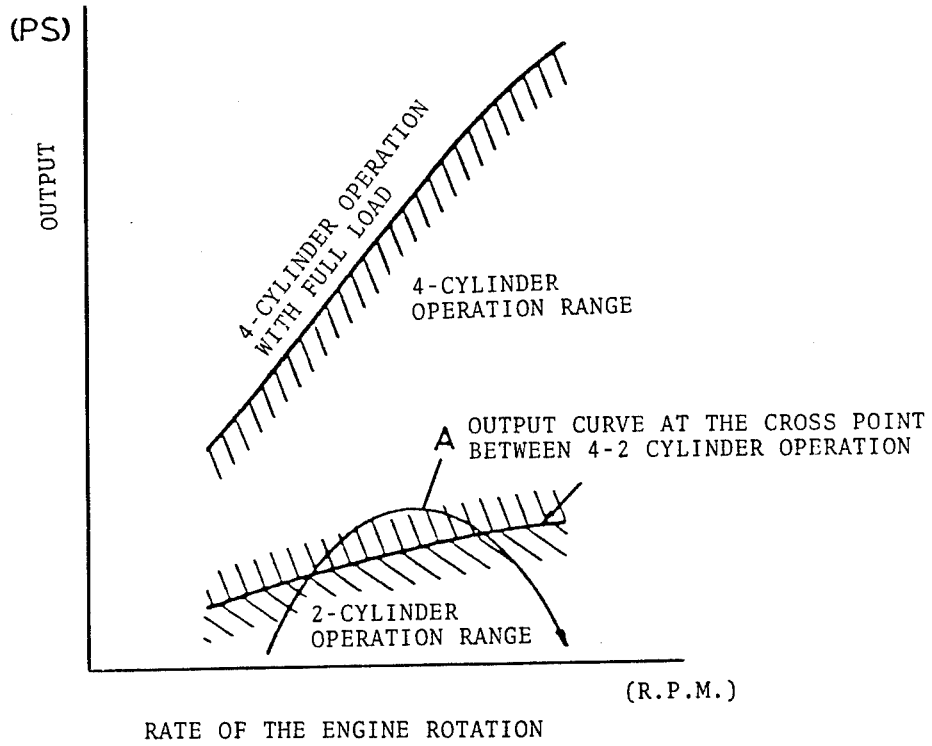

FIG. 6 is a curve of the output to show one example of the operation with a given number of cylinders held in suspension.

Figure 7:
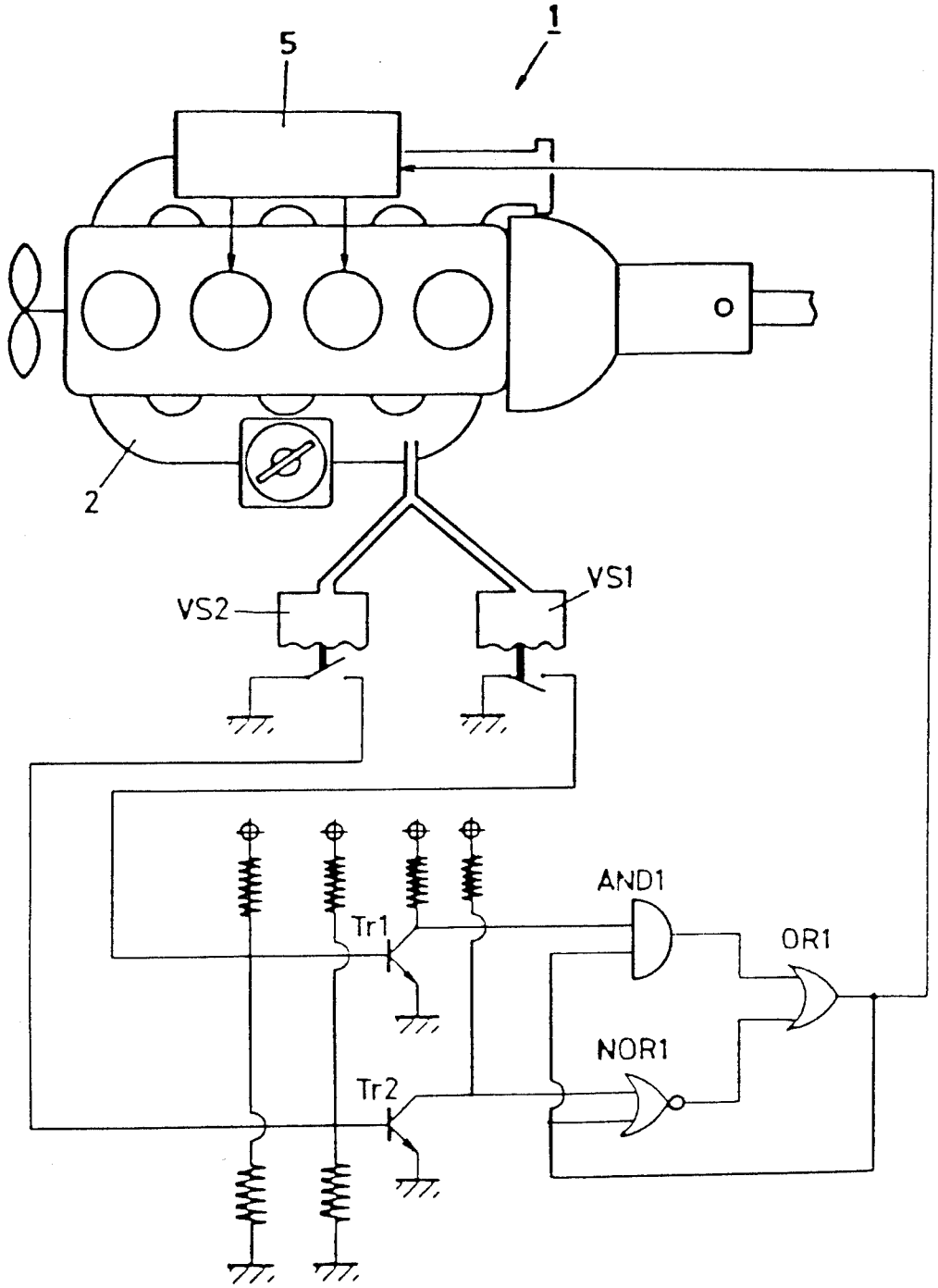

FIG. 7 shows the structure of another embodiment according to the present invention.

Figure 8:
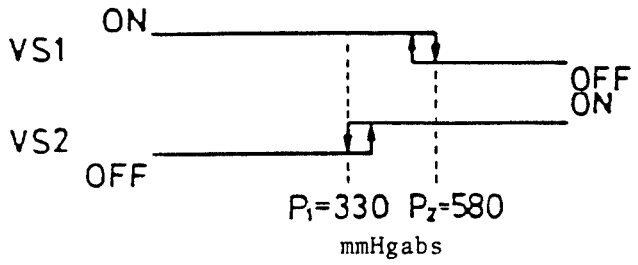

FIG. 8 is a view to explain the operation of the present switch.

Figure 9:
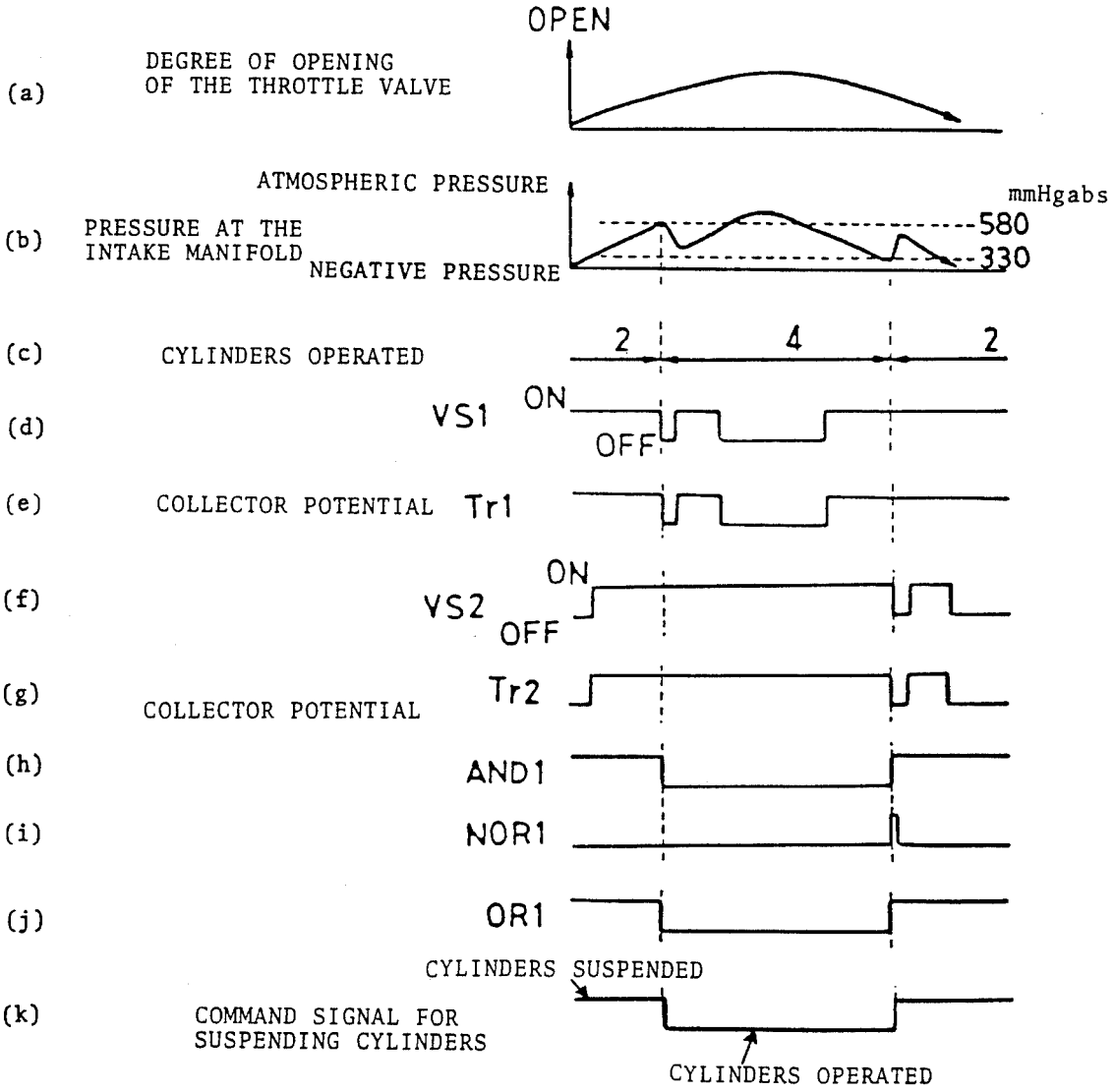

FIGS. 9(*a*)–(*k*) are the time charts of the signals at various parts.

Figure 10:
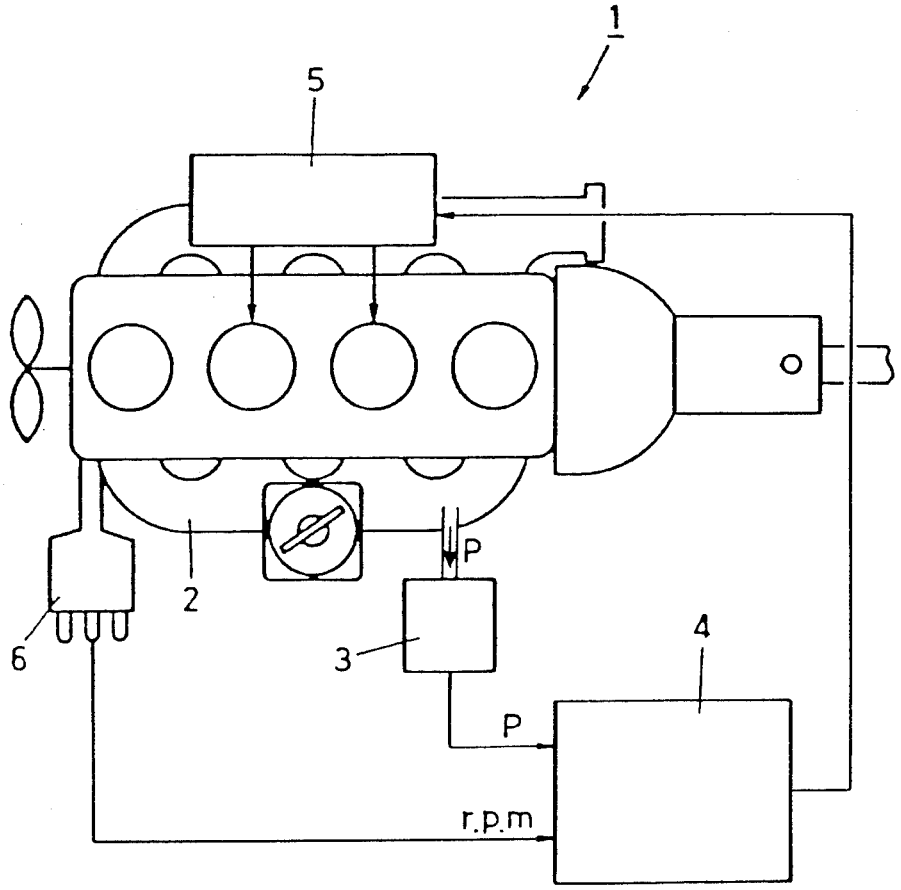

FIG. 10 shows still another embodiment according to the present invention.

Figure 11:
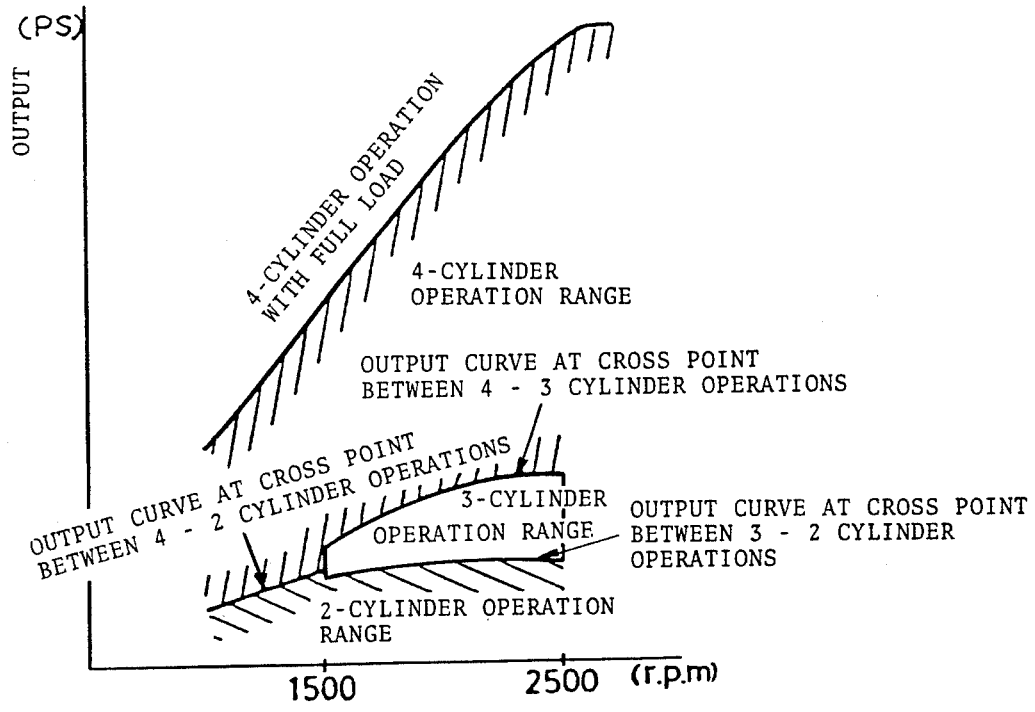

FIG. 11 shows output curves of operations with different number of cylinders held in suspension.

DETAILED DESCRIPTION OF THE INVENTION

The present invention will now be described in detail by way of embodiments with reference to the accompanying drawings.

Figure 1:
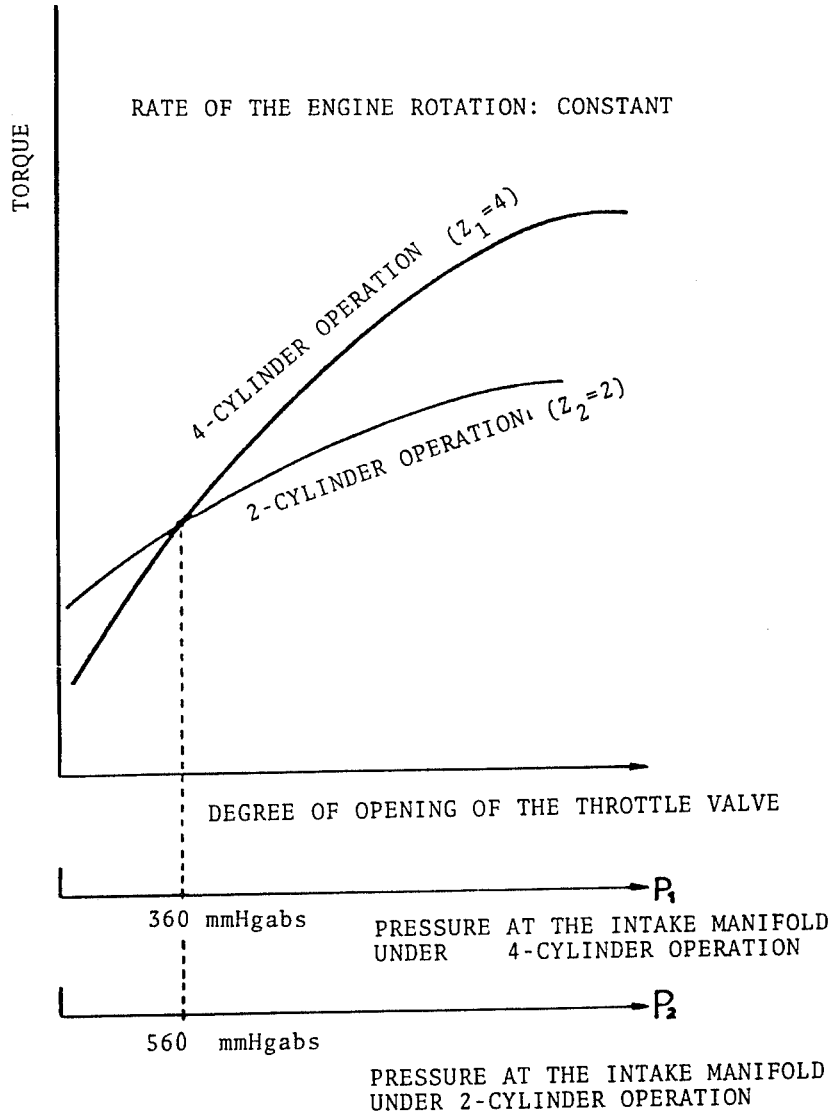

In a variable displacement engine having a plurality of cylinders which are supplied with air through one common throttle valve and provided with a system wherein suspended cylinders are not supplied with air through said throttle valve by the mechanism for stopping intake/exhaust valve operation, the atmospheric air introduction method or the exhaust gas re-cycle mechanism, there exists a point (hereinafter called the cross point) where the output of the engine under the $Z_1$-cylinder operation, i.e. 4-cylinder operation in FIG. 1, coincides with the output under the $z_2$-cylinder operation, i.e. 2-cylinder operation in FIG. 1, when the degree of opening of the throttle valve is varied while maintaining the rotation rate of the engine constant. Two outputs meet at such a point because while in the driving range where the degree of opening of the throttle valve is smaller, the combustion efficiency in the 4-cylinder operation lowers and the pumping loss increases, such defects are alleviated in the 2-cylinder operation.

Noting that such a cross point exists, the present inventors have simulated the operation of an engine at the cross point to theoretically analyze the conditions. It was found that the characteristics of the cross point (in other words the point where the outputs of $Z_1$-cylinder and $Z_2$-cylinder operations of an engine operating at a constant rate of rotation become coincided at the same degree of opening of the throttle valve) lies in that the value $P_1$, or the pressure at the intake manifold under the $Z_1$-cylinder operation and the value $P_2$, or the pressure at intake manifold under the $Z_2$-cylinder operation are determined simply by the value $Z_2/Z_1$ and the atmospheric pressure $P_3$ and are irrespective of the rate of rotation of the engine, capacity of the cylinder, and the absolute number of the cylinders. In other words, regardless of whether the displacement is 1000 cc or 2000 cc, or whether the number of cylinders is 6 or 4, the pressures $P_1$ and $P_2$ at the intake manifold at the cross point remain consistent provided the ratio $Z_2/Z_1$ or the ratio between the numbers of cylinders before and after switching (between $Z_1$-cylinder and $Z_2$-cylinder) remains the same.

Figure 2A:
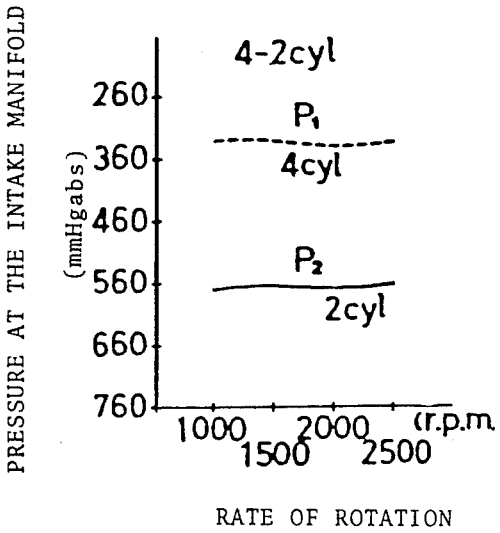
Figure 2B:
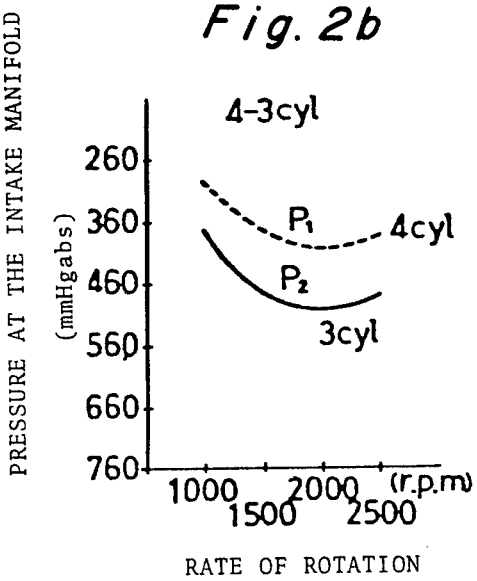
Figure 2C:
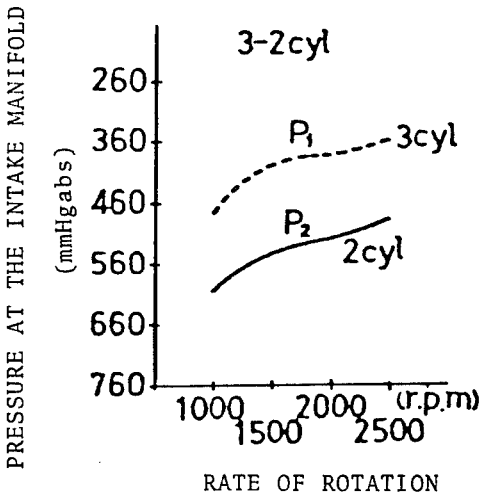

The pressure P at the intake manifold was measured using a 4-cylinder engine with 2000 cc displacement, and the results are shown in FIGS. 2(*a*), (*b*) and (*c*). In these figures, the abscissa denotes the rate of rotation of the engine (rpm) respectively while the ordinate represents the pressure (mmHg abs) at the intake manifold of the engine rotating at a given rate to generate the same output at the same degree of opening of the throttle valve. FIG. 2(*a*) shows the shift between 4 cylinders and 2 cylinders; (*b*) the shift between 4 cylinders and 3 cylinders; and (*c*) the shift between 3 cylinders and 2 cylinders. As is evident from these graphs, the result in (*a*) of shifting between 4 cylinders and 2 cylinders coincides well with the result of the theoretical analysis, and it is found that the pressure $P_1$ at the intake manifold under 4-cylinder operation ($Z_1=4$) takes consistently a value in the range of 330 to 340 mmHg abs and the pressure $P_2$ at the intake manifold under 2-cylinder operation ($Z_2=2$) takes a value in the range of between 560 and 570 mmHg abs. In the cases of (*b*) and (*c*), the results differ from that of the theoretical analysis probably because the intake stroke cycles at an irregular interval.

The results of the theoretical analysis and the experiments indicate that the pressures $P_1$ and $P_2$ at the intake manifold at the cross point take a constant value respectively for over a wider engine driving range. It is therefore possible to switch number of operating cylinders from $Z_1$ to $Z_2$ smoothly without causing change in the outputs by detecting the pressure at the intake manifold. Further, the control unit for this purpose can be made simple in construction as it only needs to detect the pressure at the intake manifold.

Figure 3:
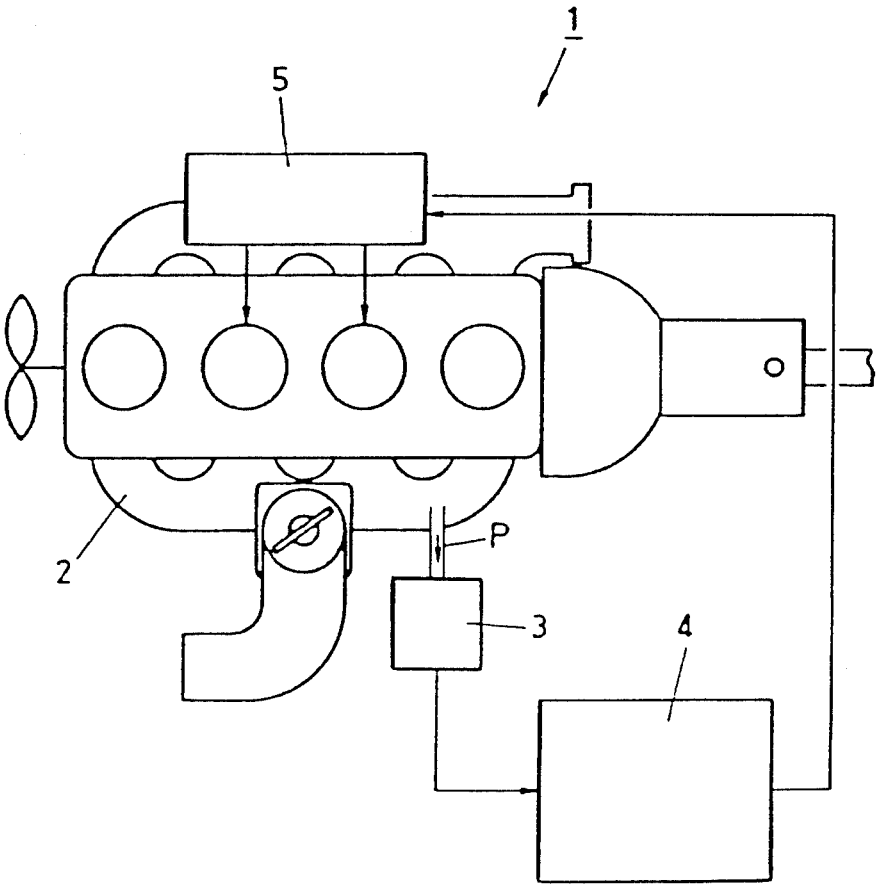
FIG. 3 shows the structure of an embodiment according to the present invention.

Referring now to FIG. 3, an embodiment of the multi-cylinder engine according to the present invention will now be described.

The control system for a 4-cylinder engine 1 comprises a pressure sensor 3 which is connected to an intake manifold 2 and which continuously converts the pressure P at the intake manifold into an electric signal to be transmitted to a control unit 4. The control unit 4 transmits to the cylinder suspension mechanism 5 a signal for suspending the cylinders, or a signal for releasing the suspension judging from the present driving condition of the engine 1 and said pressure P at the intake manifold.

Figure 4:
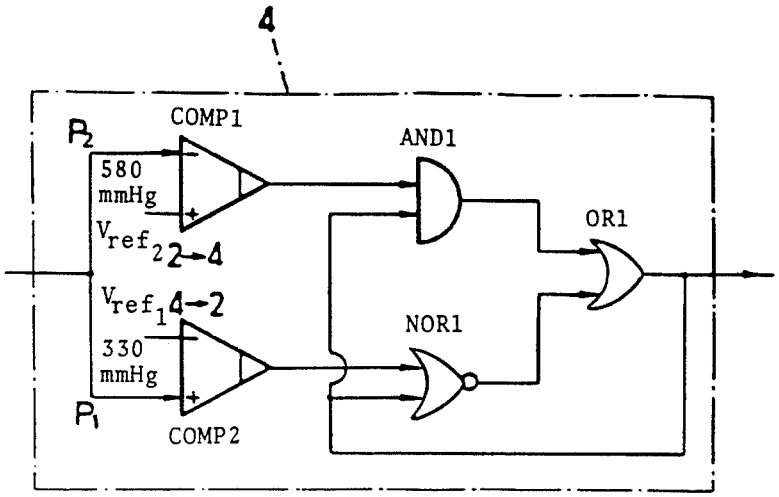
FIG. 4 is a block diagram of the control unit.

As shown in FIG. 4, the control unit 4 comprises a comparator COMP 1 which is set in advance at a reference voltage $V_{ref\,2}$ which corresponds to the intake manifold pressure $P_2=580$ mm Hg abs, or the value where the 2-cylinder operation is switched to 4-cylinder operation, and which compares the voltage with the input signal; a comparator COMP 2 which is set in advance at a reference voltage $V_{ref\,1}$ which corresponds to the intake manifold pressure $P_1=330$ mm Hg abs, or the value where the operation is shifted from 4-cylinder to 2-cylinder and compares the same with the input signal; and, a logic circuit of AND gate AND 1, NOR gate NOR 1 and OR gate OR 1 which transmits a command signal for shifting the number of the cylinders from the current number on the basis of the relation between the data from these comparators COMP 1 and COMP 2. The output of the control unit 4 is necessarily "1" when the input signal is smaller than the reference voltage $V_{ref\,1}$, and is "0" when the input signal is greater than the reference voltage $V_{ref\,2}$. When the input signal takes an intermediate value between the reference voltages $V_{ref\,1}$ and $V_{ref\,2}$, the output will vary depending on its history. In other words, when the output of the control unit 4 is "1" because the outputs of both comparators COMP 1 and COMP 2 are "1" and the output of NOR 1 is "0", then the output of AND 1 becomes "1" and the output remains to be "1". When the output of the control unit 4 is "0", on the other hand, the output of AND 1 becomes "0" and the output of the control unit 4 remains to be "0".

Under the driving operation in which the output fluctuates as is shown by the curve A of FIG. 6, the throttle valve would be manipulated in the manner as shown in FIG. 5(*a*), with the signals from various parts as shown in FIGS. 5(*d*)–(*h*), whereby a command signal for suspending the cylinders as shown in FIG. 5(*i*) will be transmitted and the pressure at the intake manifold will fluctuate as shown in FIG. 5(*b*).

The reference voltages $V_{ref\,1}$ and $V_{ref\,2}$ to be set in the comparators COMP 1 and COMP 2 are made slightly deviated from actually measured pressures at the intake manifold at the cross point, or by about 10 mm Hg abs in the present embodiment in order to prevent unstable operation due to "hunting" on the engine.

As the cylinder suspension mechanism 5 which is driven by the command signal for suspending the cylinders from the control unit 4, a conventional mechanism for stopping intake/exhaust valve operation or the like may be used, but it should be the system wherein suspended cylinders are not supplied with air via a throttle valve.

Referring now to FIGS. 7–9, another embodiment will be described.

In the embodiment shown in FIG. 7, pressure switches VS 1 and VS 2 which switch on and off at a pre-determined point are employed in place of the pressure sensor of the above embodiment, and transistors $T_{r1}$ and $T_{r2}$ function as the comparators. Other component parts are identical with those in the first embodiment with identical reference numbers, and the explanation is omitted where overlapping. As shown in FIG. 8, the pressure switches VS 1 and VS 2 switch on and off at the intake-manifold pressures $P_1=330$ mm Hg abs and $P_2=580$ mm Hg abs at the cross point. Hysteresis is provided to prevent "hunting" on the engine 1. When the throttle valve is manipulated in the manner as shown in FIG. 9(*a*), the signals from various parts become as shown in FIGS. 9(*b*)–(*k*) to achieve the control as mentioned above.

In the foregoing, the embodiments were described in terms of switching between 4-cylinder operation, or $Z_1=4$, and 2-cylinder operation, or $Z_2=2$, where a relation of $Z_1=2\cdot Z_2$ holds, and where the intake stroke in both $Z_1$ and $Z_2$-cylinder operations cycles at a regular interval, these conditions being approximately the same with those of the theoretical model with the intake-manifold pressures $P_1=330$, $P_2=580$ mm Hg abs respectively at the cross point. The embodiment(s) to be described below relates to switching between 4 cylinders, 3 cylinders and 2 cylinders. In these cases, as has already been mentioned with respect to FIGS. 2(*a*), (*b*) and (*c*), the intake-manifold pressures $P_1$ and $P_2$ do not take a certain value except at the point of shifting between 4-cylinder and 2-cylinder operations. The intake-manifold pressures should therefore be determined with due consideration of the rotation rate of the engine, as shown in Table 1.

TABLE 1

| Cylinders in operation | Pressure at the intake manifold | Rate of engine rotation |
|---|---|---|
| 2 → 4 cylinders | 580 mm Hg abs | 1500 rpm and less |
| 4 → 2 | 330 | |
| 2 → 3 | 540 | 1500~ |
| 3 → 2 | 360 | 2500 |
| 3 → 4 | 500 | |
| 4 → 3 | 380 | |
| 4 | — | 2500 and more |

FIG. 10 shows the structure for regulating the number of cylinders held in suspension according to Table 1. The embodiment shown in FIG. 3 is further provided with a distributor 6 which transmits ignition pulse in order to detect the engine rotation rate and to input the same at the control unit 4. Various means can be used to detect the rate of engine rotation such as a magnet pickup which may be provided opposing the ring gear of the flywheel. The output of the variable displacement engine 1 of this construction is controlled in various ranges as shown in FIG. 11. By controlling by such fine ranges the features of the variable displacement engine will be enhanced, and a smooth operation of the engine will be ensured since there is no fluctuation of the output at the time of shifting.

As has been described in the foregoing embodiments, the present invention enables a smooth shifting of the number of cylinders in operation by simply detecting the pressures at the intake manifold without causing fluctuation in the output.

What we claim:

1. A multi-cylinder internal combustion engine comprising a plurality of cylinders which are supplied with air via one common throttle valve, a cylinder number regulation unit for regulating the number of cylinders in operation which suspends operation of a part of cylinders by intercepting the air supply to said cylinders, a pressure sensor which detects the intake manifold pressure at the downstream side of said throttle valve, and a control unit which receives as input the result of the detection by said pressure sensor and outputs a command signal to said cylinder number regulation unit so as to switch the number of operating cylinders from one to the other when said intake manifold pressure reaches a first switch value, and to switch back said number from that number to the previous number when said intake manifold pressure reaches a second switch value, which is characterized in that said first switch value is determined at a value equal to the intake manifold pressure which is substantially constant over a wide range of engine revolution speed before the switch while the second switch value is set at a value equal to the intake manifold pressure value which is substantially constant over a wide range of engine revolution speed after the switch if the number of the operating cylinders is switched from said number to said another number so as to make the engine output before such switching substantially identical with the engine output after such switching.

2. The multi-cylinder internal combustion engine as claimed in claim 1 characterized in that said pressure sensor is so constructed as to output an electric signal corresponding to said intake manifold pressure to said control means and said control means is provided with a comparator which compares a first and a second reference electric signals corresponding to said first and second switch values with the electric signal from said pressure sensor and a logic circuit which outputs said command signal to said cylinder number regulation unit in accordance with the output from said comparator.

3. The multi-cylinder internal combustion engine as claimed in claim 1 which is characterized in that said control means is provided with a pressure switch which is turned ON/OFF when said pressure sensor detects said first switch value, a pressure switch which is turned ON/OFF when said pressure sensor detects the second switch value and an electric means which outputs said command signal to said cylinder number regulation unit in accordance with ON/OFF signals from both pressure switches.

* * * * *